US006799685B1

(12) United States Patent
Yuyama et al.

(10) Patent No.: US 6,799,685 B1
(45) Date of Patent: Oct. 5, 2004

(54) MEDICATION PACKING APPARATUS

(75) Inventors: Shoji Yuyama, Toyonaka (JP); Nakaji Takeda, Toyonaka (JP); Takamitsu Inahara, Toyonaka (JP); Noriyuki Iiboshi, Toyonaka (JP); Toshifumi Matsushita, Toyonaka (JP)

(73) Assignee: Yuyama MFG. Co., Ltd., Osaka-fu (JP)

( * ) Notice: Subject to any disclaimer, the term of this patent is extended or adjusted under 35 U.S.C. 154(b) by 736 days.

(21) Appl. No.: 09/699,507

(22) Filed: Oct. 31, 2000

(30) Foreign Application Priority Data

Nov. 1, 1999 (JP) ..... 11-311062
Nov. 1, 1999 (JP) ..... 11-311063

(51) Int. Cl.[7] ..... B07C 5/00
(52) U.S. Cl. ..... 209/552; 209/617
(58) Field of Search ..... 207/540, 542, 207/552, 586, 617, 655; 53/504

(56) References Cited

U.S. PATENT DOCUMENTS 4,018,029 A * 4/1977 Safranski et al. ..... 53/502
4,399,367 A * 8/1983 Grube et al. ..... 250/559.4
4,894,977 A * 1/1990 Rittinger et al. ..... 53/453
4,971,513 A * 11/1990 Bergerioux et al. ..... 414/807
6,324,253 B1 * 11/2001 Yuyama et al. ..... 378/57
RE37,829 E * 9/2002 Charhut et al. ..... 700/216
2003/0131567 A1 * 7/2003 Timmerman et al. ..... 53/450

FOREIGN PATENT DOCUMENTS

JP 10-101018 4/1998

* cited by examiner

*Primary Examiner*—Donald P. Walsh
*Assistant Examiner*—Joseph Rodriguez
(74) *Attorney, Agent, or Firm*—Wenderoth, Lind & Ponack L.L.P.

(57) ABSTRACT

A medicine packing apparatus feeds medicine in accordance with prescription data and then separates and packs the medicine by one dose. A discriminating mechanism (4) determines the type of medicine package belt to be formed in accordance with prescription data. A distributing member (42) distributes the medicine package belt based on the determination of the discriminating mechanism (4). Thus, according to the present invention, a different configuration of medicine package belts can be properly distributed and transferred based on the use thereof.

17 Claims, 12 Drawing Sheets

(a)

(b)

MEDICATION PACKING APPARATUS

BACKGROUND OF THE INVENTION

The present invention relates to a medicine packing apparatus, and particularly to a medicine packing apparatus that can properly distribute and transfer medicine package belts based on the configuration of the medicine package belt.

Conventionally, there has been a medicine packing apparatus that feeds medicine in accordance with prescription data, and then separates and packs the medicine by one dose to form a series of medicine doses packaged in a belt. There have also been well known a reel apparatus for reeling the formed medicine package belt and a binding apparatus for binding the reeled medicine package belts.

Recently, different kinds of medicine package belts according to the use thereof have been required. For example, in the case of dosage for an outpatient, it has been desired to provide long medicine package belts in which medicine doses are packed in series in order of dose. On the other hand, in the case of dosage for an inpatient, short medicine package belts cut by one-day dosage (for example, 3 packages of medicine for taking after breakfast, lunch and supper) have been provided. There are also blank package belts in each of which no medicine is packed. The long and short medicine package belts are bound by separate binding apparatuses respectively, while the blank package belts are discarded.

However, the conventional apparatuses have no construction for distributing the medicine package belts based on the configuration thereof. Therefore, the aforementioned reel apparatus and the binding apparatus have been separately positioned from the medicine packing apparatus so that the long medicine package belts are reeled and bound only when providing them to the outpatients. When providing the medicine package belts to inpatients, the pharmacist or other provider needs to conduct work by cutting the medicine package belts and binding them by a rubber band or the like. Even when the short medicine package belts cut by one-day dosage are requested by the outpatient, the work for cutting the medicine package belts is necessary. In addition, in the conventional medicine packing apparatus, transfer mechanisms adapted to the configuration of the medicine package belts are necessary, resulting in complexity of construction.

SUMMARY OF THE INVENTION

Therefore, it is an object of the present invention to provide a medicine packing apparatus that can properly distribute and transfer different configurations of medicine package belts based on use thereof.

As a first means to solve the above problems, the present invention provides a medicine packing apparatus which feeds medicine in accordance with prescription data, and then separates and packs the medicine by one dose to form a series of medicine doses packaged in belts. The apparatus comprises a discriminating means for discriminating (determining) a supply configuration of the medicine package belt to be formed in accordance with prescription data; and a distributing means for distributing (controlling) a conveying direction of the medicine package belt based on the discriminating result of the discriminating means.

According to this construction, the type of medicine package belt can be automatically discriminated to distribute the medicine package belt. Then, a proper process in compliance with the type of medicine package belt can be conducted.

In this case, it is preferable that the apparatus further comprises a reel member for reeling the long medicine package belt, and a guide member for guiding and collecting the short medicine package belts. When a long medicine package belt is discriminated by the discriminating means, the distributing means distributes the long medicine package belt toward the reel member, while when a short medicine package belt is discriminated by the discriminating means, the distributing means distributes the short medicine package belt toward the guide member.

It is preferable that the guide member can be changed in the guide position thereof in accordance with the length of the short medicine package belt to be distributed.

It is preferable that when a blank package belt is discriminated by the discriminating means, the distributing means distributes the blank package belt toward a discharge position. Thus, it is possible to attempt further automatization.

As a second means to solve the problems, the present invention provides a medicine packing apparatus which feeds medicine in accordance with prescription data, and then separates and packs the medicine by one dose to form a series of medicine doses packaged in a belt. The apparatus comprises a discriminating means for discriminating (determining) a supply configuration of the medicine package belt to be formed in accordance with prescription data; a gripping means having a first arm and a second arm, an open angle between the arms being changeable in accordance with the supply configuration discriminated by the discriminating means; and a moving means for moving the medicine package belt gripped by the gripping means to a binding position.

According to this construction, it is possible to operate the gripping means so as to properly grip the medicine package belt in accordance with the supply configuration.

It is preferable that when a long medicine package belt to be supplied in a reeled condition is discriminated by the discriminating means, the gripping means changes the open angle between the arms to a maximum angle and moves toward the long medicine package belt of reeled condition to grip it. When a short medicine package belt to be supplied in a collected condition is discriminated by the discriminating means, the gripping means changes the open angle between the arms to a normal angle and waits for the short medicine package belt to be supplied at a supply position. Thus, the gripping means opens and closes the arms and collects the short medicine package belts to grip it.

It is also preferable that one of the arms of the gripping means has a press surface and that the moving means turns the gripping means so that the press portion presses the medicine package belt bound in the binding position to discharge it. Thus, the discharge of the bound medicine package belts can be conducted without needing another additional member.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Hereinafter, an embodiment according to the present invention will be explained in accordance with the accompanying drawings.

Figure 1:
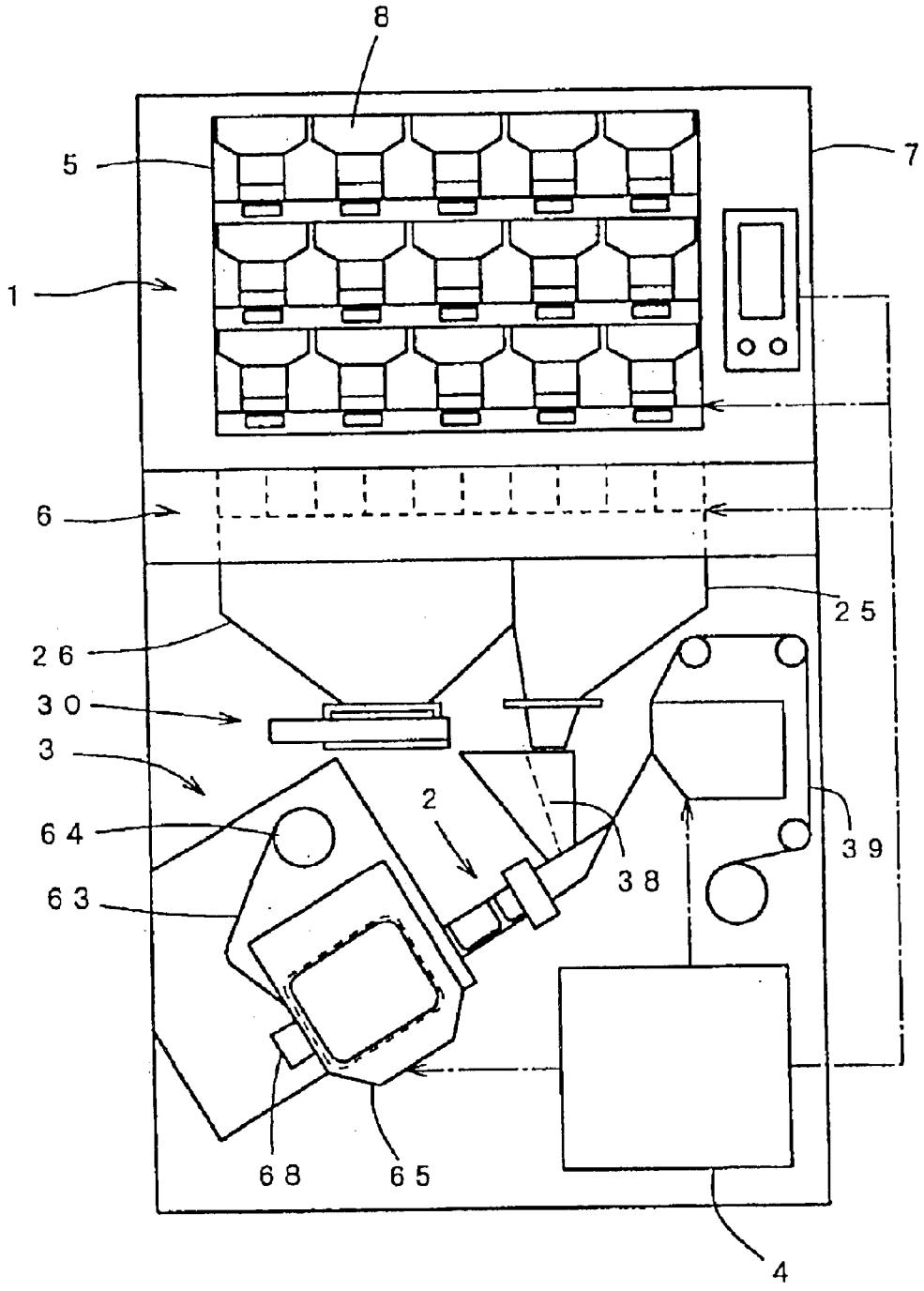
FIG. 1 is a schematic front view of a medicine packing apparatus according to the present invention.

FIG. 1 shows a medicine packing apparatus according to the present embodiment. The medicine packing apparatus comprises a medicine feed section 1, a medicine packing section 2, a medicine package belt binding section 3 and a control section 4 for driving and controlling these sections. In this embodiment, the control section 4 acts as a discriminating mechanism of the present invention.

The medicine feed section 1 includes a medicine automatic feed portion 5 and a medicine manual feed portion 6.

The medicine automatic feed portion 5 is provided with a total of fifteen medicine feeders 8 of three vertically spaced stages and five horizontally spaced columns in an upper panel 7. For each column of the medicine feeders 8, medicine passages 16 are formed. The medicine feeders 8 situated at the uppermost position are set at the necessary height for an operator to access them without using a stool.

Figure 2:
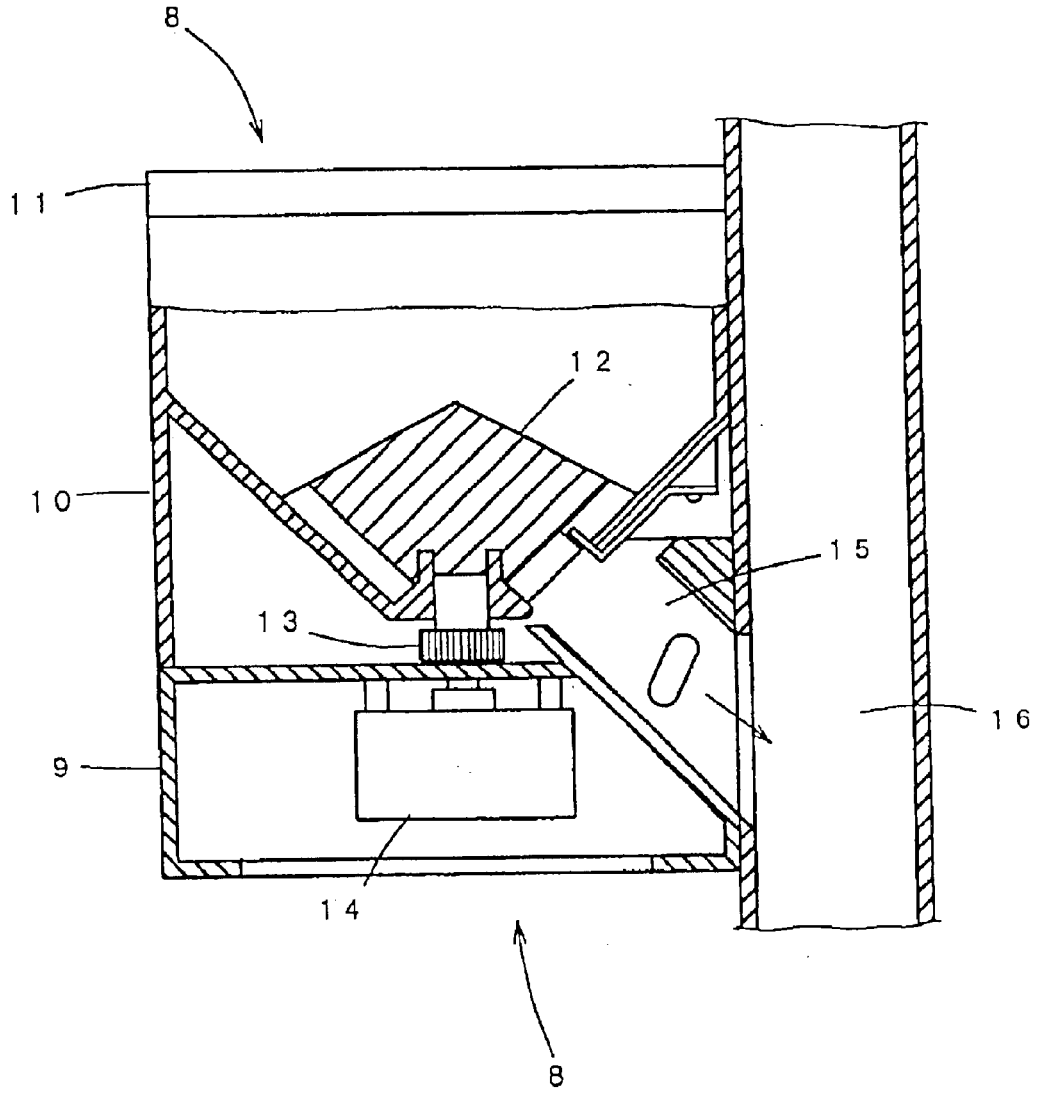
FIG. 2 is a sectional view showing a medicine feeder of FIG. 1.

Each medicine feeder 8, as shown in FIG. 2, comprises a motor base 9 and a feeder vessel 10 detachably mounted on the motor base 9. The feeder vessel 10 has a substantially rectangular shape with an upper opening closed by a cover 11. Each feeder vessel 10 contains a different kind of medicine respectively. In the present embodiment, the feeder vessels 10 in the two columns on the right side contain pyrazolone medicine, while the feeder vessels 10 in the three columns on the left side contain nonpyrazolone medicine. On the bottom of the feeder vessel 10 is a rotor 12. The rotor 12 is rotated through a gear 13 by a motor 14 in the motor base 9. Then the rotor 12 discharges the medicine contained in the feeder vessel 10 one-by-one through a drop guide passage 15 to the medicine passage 16.

Figure 3:
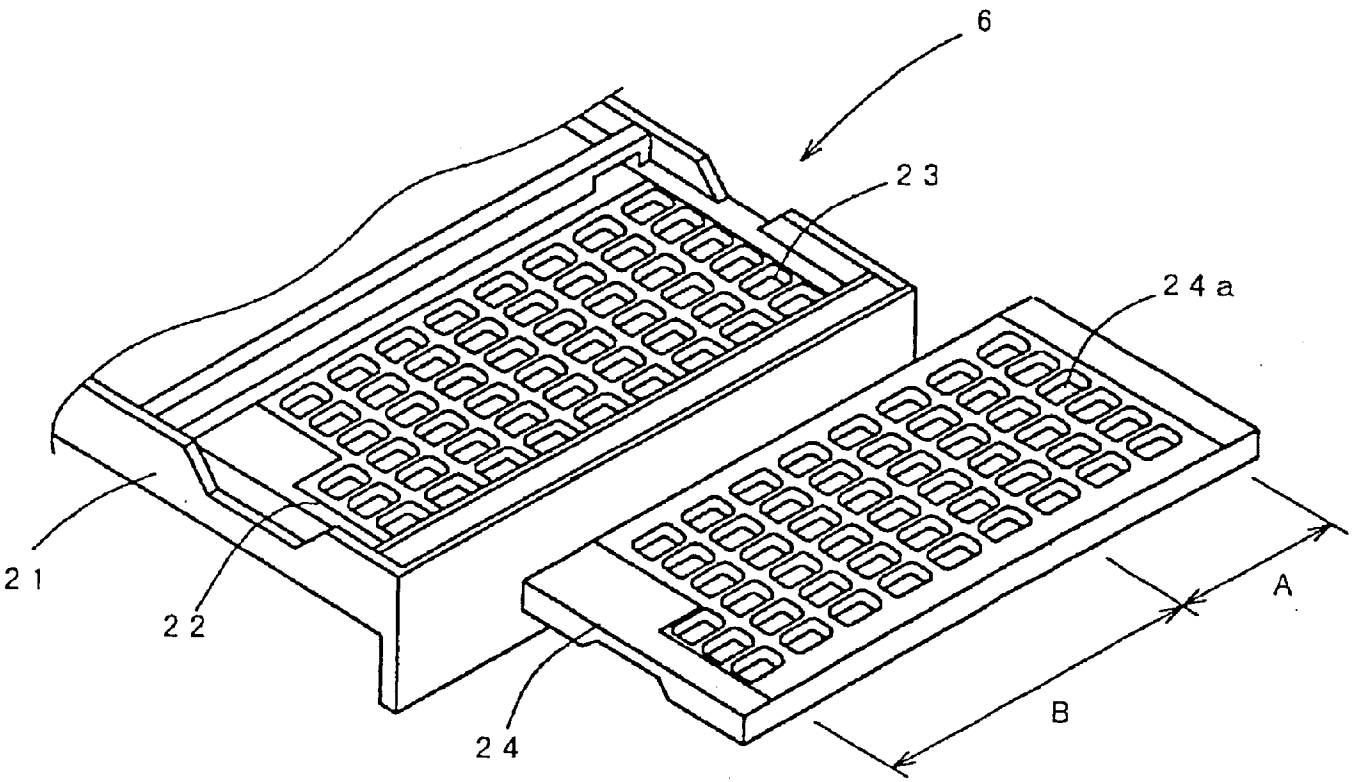
FIG. 3 is an exploded perspective view showing a manual medicine feed section of FIG. 1.

The medicine manual feed portion 6 is arranged to feed medicine (medicine having little chance of being dispensed or medicine having a broken quantity, such as half-tablets or so) that are not contained in the medicine feeders 8 of the medicine automatic feed portion 5 (for details, refer to Japanese Patent publication 6-37202). As shown in FIG. 3, the medicine manual feed portion 6 is provided with a tablet bucket 22 on a support frame 21. The tablet bucket 22 is formed with a plurality of distributor boxes 23 by partitioning the tablet bucket 22 like a grating. The medicine manual feed portion 6 is provided with a tablet tray 24 having a plurality of distributor boxes 24*a* with the same construction as those of the tablet bucket 22. The medicine contained in the tablet tray 24 in advance are simultaneously supplied to each distributor box 23. The different kinds of medicines are supplied to the distributor boxes 23 in an area A and an area B of the tablet bucket 22. In the present embodiment, the distributor boxes 23 in the area A are supplied with pyrazolone medicine, while the distributor boxes 23 in the area B are supplied with nonpyrazolone medicine. The bottom of each distributor box 23 is opened in order of position from the distributor box 23 positioned at one end. The operator has to distribute a necessary number of required tablets by handwork (manual distribution) based on the order of opening the distributor boxes 23. The position of the medicine manual feed portion 6 is set at such a height that the operator can easily manually distribute the medicine in each distributor box 23.

Beneath the medicine feed section 2, as shown in FIG. 1, a first hopper 25 and a second hopper 26 are disposed. Each hopper 25, 26 has the shape a of substantially truncated pyramid, and is made of transparent synthetic resin. Thus, the medicine passing through each hopper 25, 26 can smoothly drop downward even in a narrow space limited in a vertical direction. From the view point of workability, the medicine automatic feed portion 5 and the medicine manual feed portion 6 are restricted in their position. Therefore, if a single hopper is disposed in the narrow space limited in a vertical direction, it is not possible to make the angle of the inner surface of the hopper large, resulting in difficulty of smoothly dropping the medicine. According to the hoppers 25, 26 of the present embodiment, each hopper receives the dropping medicine within the extent of each limited area, allowing the angle of the inner surface of each hopper to be made large enough.

The first hopper 25 is provided so as to correspond (communicate with) to both the feeder vessels 10 of the medicine automatic feed portion 5 in the two columns on the right side and the distributor boxes 24*a* of the medicine manual feed portion 6 on the right side. On the other hand, the second hopper 26 is provided so as to correspond to (communicate with) both the feeder vessels 10 of the medicine automatic feed portion 5 in the three columns on the left side and the distributor boxes 24*a* of the medicine manual feed portion 6 on the left side. Thus, even if the pyrazolone medicine remains inside of the first hopper 25 or so, the nonpyrazolone medicine passes through the second hopper 26, preventing the pyrazolone medicine from adhering to the surface of the nonpyrazolone medicine. Therefore, it is possible to securely deliver the medicine to a patient who is allergic to pyrazolone medicine.

Figure 4:
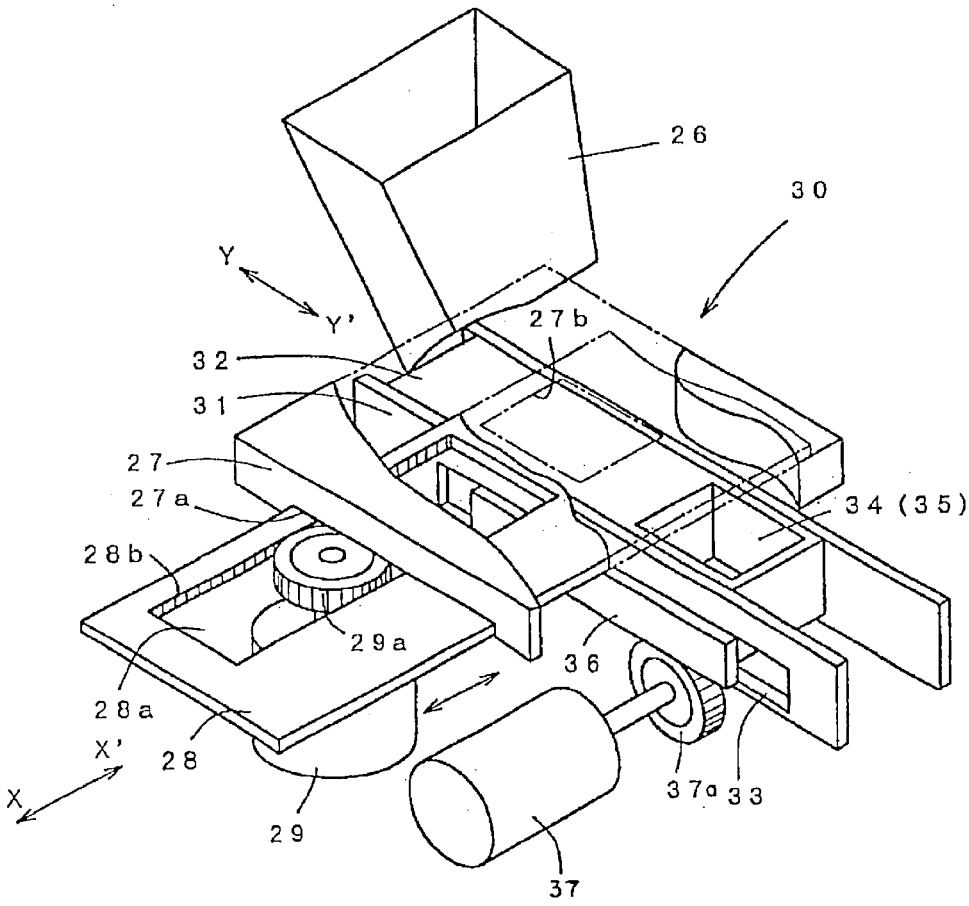
FIG. 4 is a perspective view showing a medicine delivery device of FIG. 1.

Beneath the second hopper 26, as shown in FIG. 4, is a shutter 28 which is slidably guided by a shutter guide 27. The shutter guide 27 has a plate-like shape. On the center of the lower surface of the shutter guide, a groove (recessed) portion 27*a* for guiding both sides of the shutter 28 is formed. On one end of the shutter guide 27, a through hole 27*b* is formed so as to be positioned beneath the lower opening of the second hopper 26. The shutter 28 has a plate-like shape with a thickness substantially the same as the depth of the groove portion 27*a*. The shutter 28 is formed with a rectangular aperture 28*a*. On an inner edge of the rectangular aperture 28*a* is formed a rack 28*b* which engages a shutter gear 29*a*. Driving a shutter motor 29 to rotate the shutter gear 29*a* allows the shutter 28 to move in the direction of X, X' as shown in FIG. 4.

Under the shutter 28, there is disposed a medicine delivery device 30 comprising a delivery guide portion 31 and a delivery vessel 32 slidably guided by the delivery guide portion 31.

The delivery guide portion 31 is substantially U-shaped and is formed with a long aperture 33 in one of the side walls thereof. On one end of the delivery vessel 32, there is formed a rectangular through hole 34 which opens in both upper and lower directions. The through hole 34 and the bottom of the delivery guide portion 31 define a delivery recess portion 35. On the side surface of the delivery vessel 32 is a rack portion 36 laterally protruding through the long aperture 33 of the delivery guide portion 31. The rack portion 36 engages with a delivery gear 37 provided on a base. Driving a delivery motor 38 to rotate the delivery gear 37 allows the delivery vessel 32 to move in the direction of Y, Y' as shown in FIG. 4.

On the other hand, beneath the first hopper 25 there is a removable common hopper 38. The inside of the common hopper 38 is partitioned to form both a passage for the pyrazolone medicine and a passage for the nonpyrazolone medicine independent from each other. Alternatively, two hoppers of the same shape with no partition formed may be prepared as the common hopper 38 so that the hoppers can be replaced with each other in both the case of supplying the nonpyrazolone medicine through the medicine delivery device 30 and the case of supplying the pyrazolone medicine through the first hopper 25. The lower opening of the common hopper 38 is positioned on an opening of a medicine package produced by the medicine packing section 2.

Figure 5:
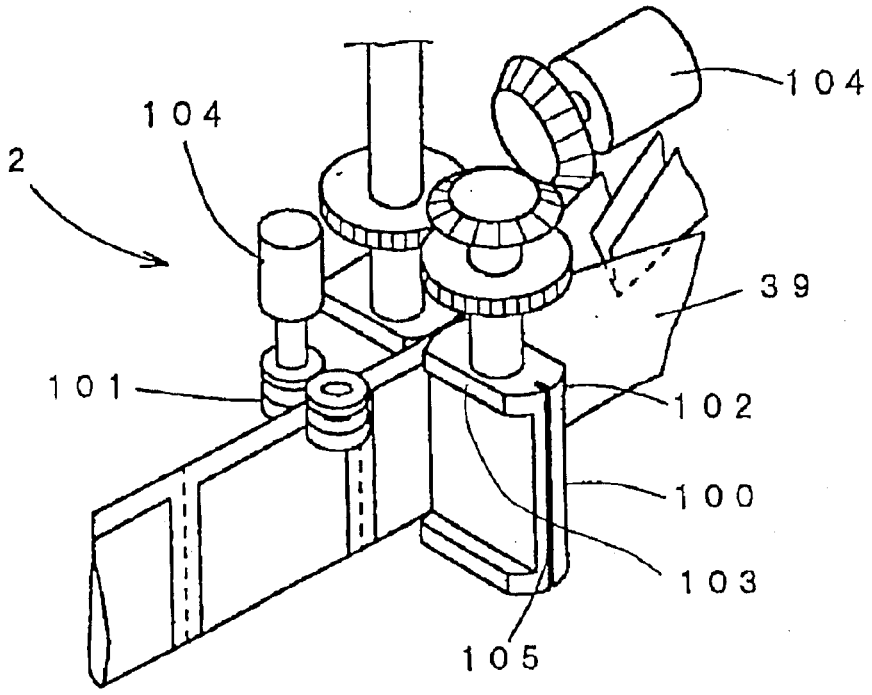
FIG. 5 is a perspective view showing a medicine packing section of FIG. 1.

The medicine packing section 2, as shown in FIG. 5, comprises a pair of cross (transverse) heating heat rollers 100 and a pair of longitudinal heating heat rollers 101, which are disposed in a conveyance passage of a packing sheet 39. The former heats the sheet in a sheet width direction, while the latter heats the side edge of the sheet. The cross heating heat rollers 100 have a cross heating surface 102 with a segment shape and a feed surface 103 with a straight shape. Each pair of rollers 100 and 101 is connected to a drive motor 104 via a transmission mechanism comprising gears. In the medicine packing section 2, the feed surfaces 103 of the cross heating heat rollers 100 are opposed to each other, and the longitudinal heating heat rollers 101 are rotated. Then, the cross heating surfaces 102 of the cross heating heat rollers 100 are opposed to each other to seal the packing sheet 39. Thus, the size of the medicine package can be changed by properly adjusting the quantity of movement of the packing sheet 39 until it is sealed. At this time, a roulette can be formed on the sealed medicine package by means of a roulette blade 105 on the cross heating surface 102 of the cross heating heat roller 100 (if necessary, refer to Japanese Laid-open patent publication 8-230832 and Japanese Laid-open patent publication 9-202301).

Figure 6:
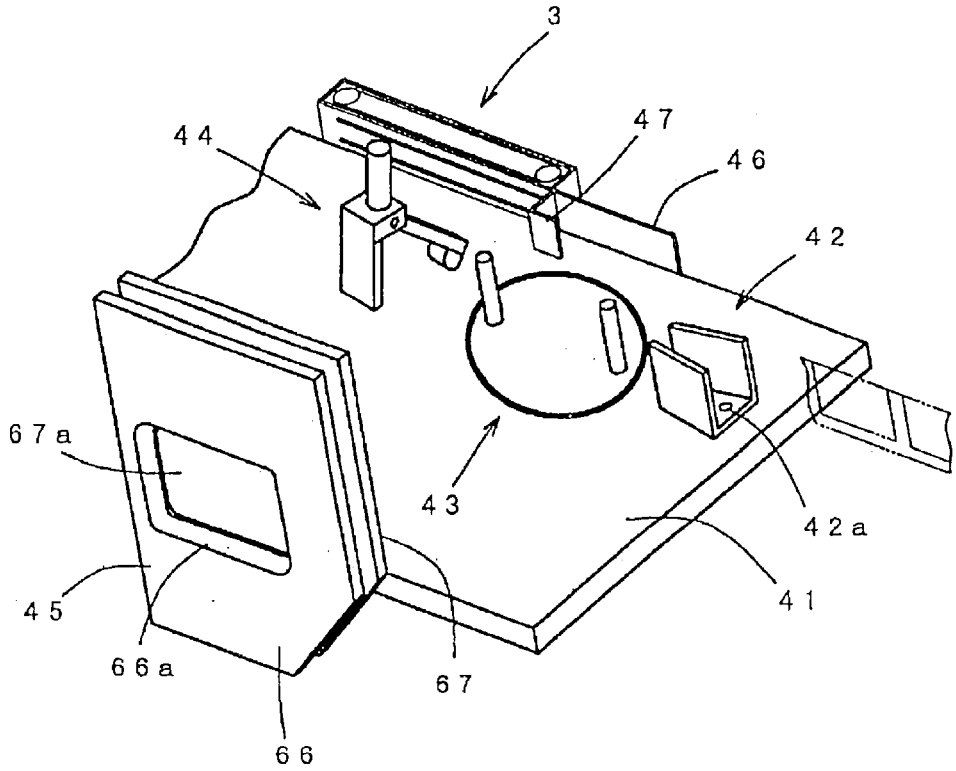
FIG. 6 is a perspective view showing a medicine package belt binding section of FIG. 1.

In the medicine package belt binding section 3, as shown in FIG. 6, a distributing member 42, a reel member 43, a gripping member 44, and a binding member 45 are provided on an inclined plate 41.

The inclined plate 41 is inclined obliquely downward along a moving direction of the formed medicine package belts. On the side edge of the inclined plate 41 is formed a guide wall 46 in a right-angled direction to the surface of the inclined plate 41. On the guide wall 46, there is a guide piece 47 which is movable back and forth along the inclined direction of the inclined plate 41. The guide piece 47 is substantially L-shaped and protrudes from the guide wall 46 so that the short medicine package belt cut every predetermined number of packages is guided between the guide wall 46 and the guide piece 47. The guide piece 47 and the guide wall 46 have such a height that the medicine package belt protrudes from the upper edges thereof so as to be gripped by the gripping member 44.

The distributing member 42 is fabricated by bending a plate to be substantially U-shaped. The distributing member 42 is mounted on the upper side of the inclined plate 41. The distributing member 42 is pivotable around a support shaft 42*a* by the rotation of a motor (unshown) so that the medicine package belt can be distributed (i.e., directed) in one of three directions in accordance with the packing configuration thereof in the medicine packing section 2. In the present embodiment, for example, the short medicine package belts cut every three packages, the long medicine package belts and the blank package belts can be distributed in three different directions, respectively. Namely, the short medicine package belts are distributed (directed) to the guide wall 46 and the guide piece 47, the long medicine package belts are distributed (directed) to the reel member 43, and the blank package belts are distributed (directed) to the binding member 45.

Figure 8:
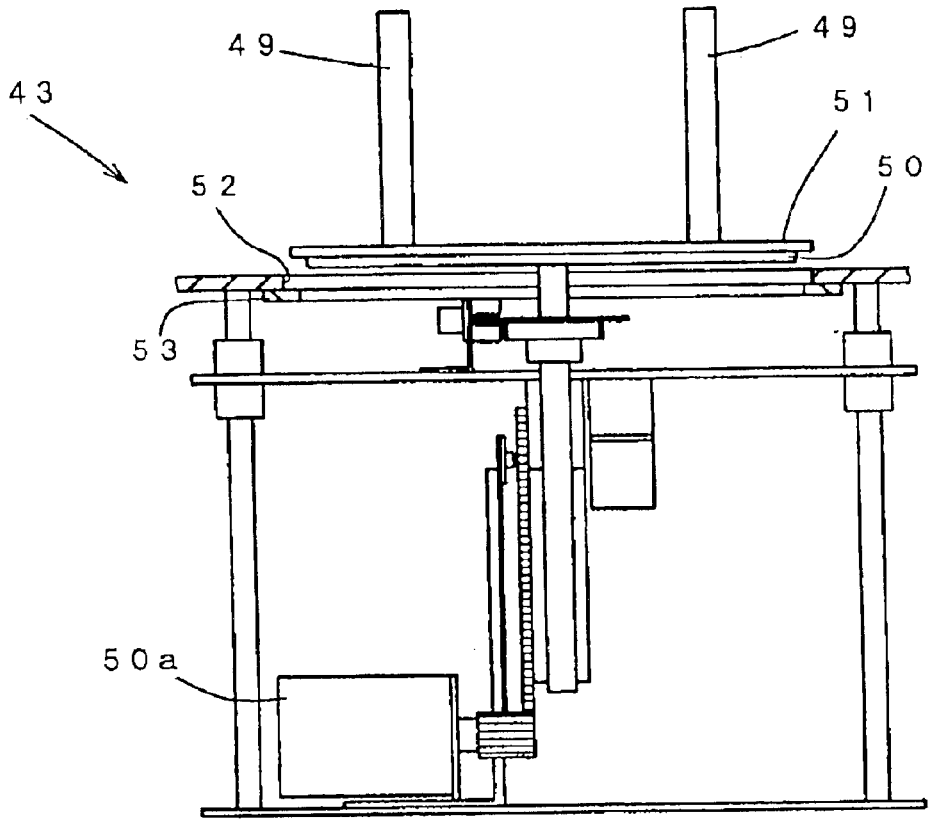
FIG. 8*a* is a front view showing a reel member of FIG. 6.
FIG. 8*b* is a plan view thereof.
Figure 8:
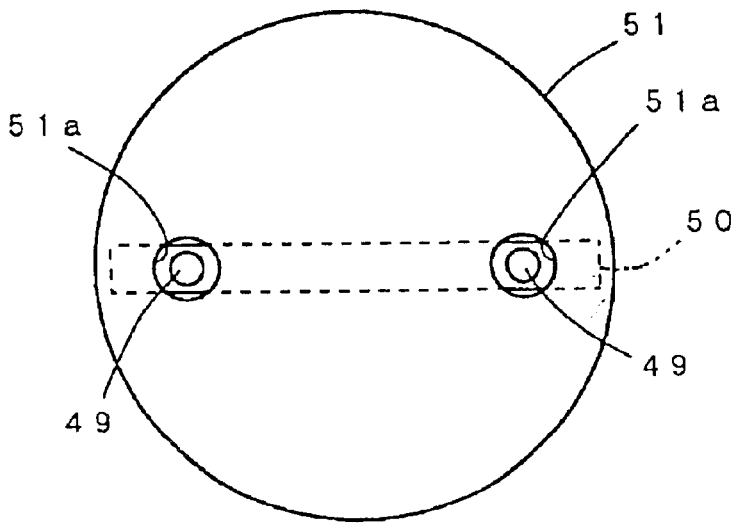

The reel member 43, as shown in FIG. 8, comprises a support portion 50 having guide shafts 49 in both end portions thereof The support portion 50 can descend and ascend by means of a motor 50*a*, and can also rotate by means of an unshown motor. A circular plate 51 having apertures 51*a* rests on the support portion 50 so that the guide shafts 49 can slidably penetrate into the apertures 51*a*. The inclined plate 41 is formed with an opening portion 52 through which the support portion 50 descends and ascends. A stopper plate 53 is fixed on the lower inner periphery of the opening portion 52, which allows the support portion 50 to move downward and prevents the circular plate 51 from moving downward. In the reel member 43, the support portion 50 is rotated at the upper position to reel the medicine package belt around the guide shafts 49. Then, the support portion 50 is driven to descend so that the guide shafts 49 are released from the medicine package belt and the medicine package belt is supported on the circular plate 51. Thus, the medicine package belt reeled by the reel member 43 can be smoothly conveyed only by gripping and turning the medicine package belt with the gripping member 44.

Figure 9:
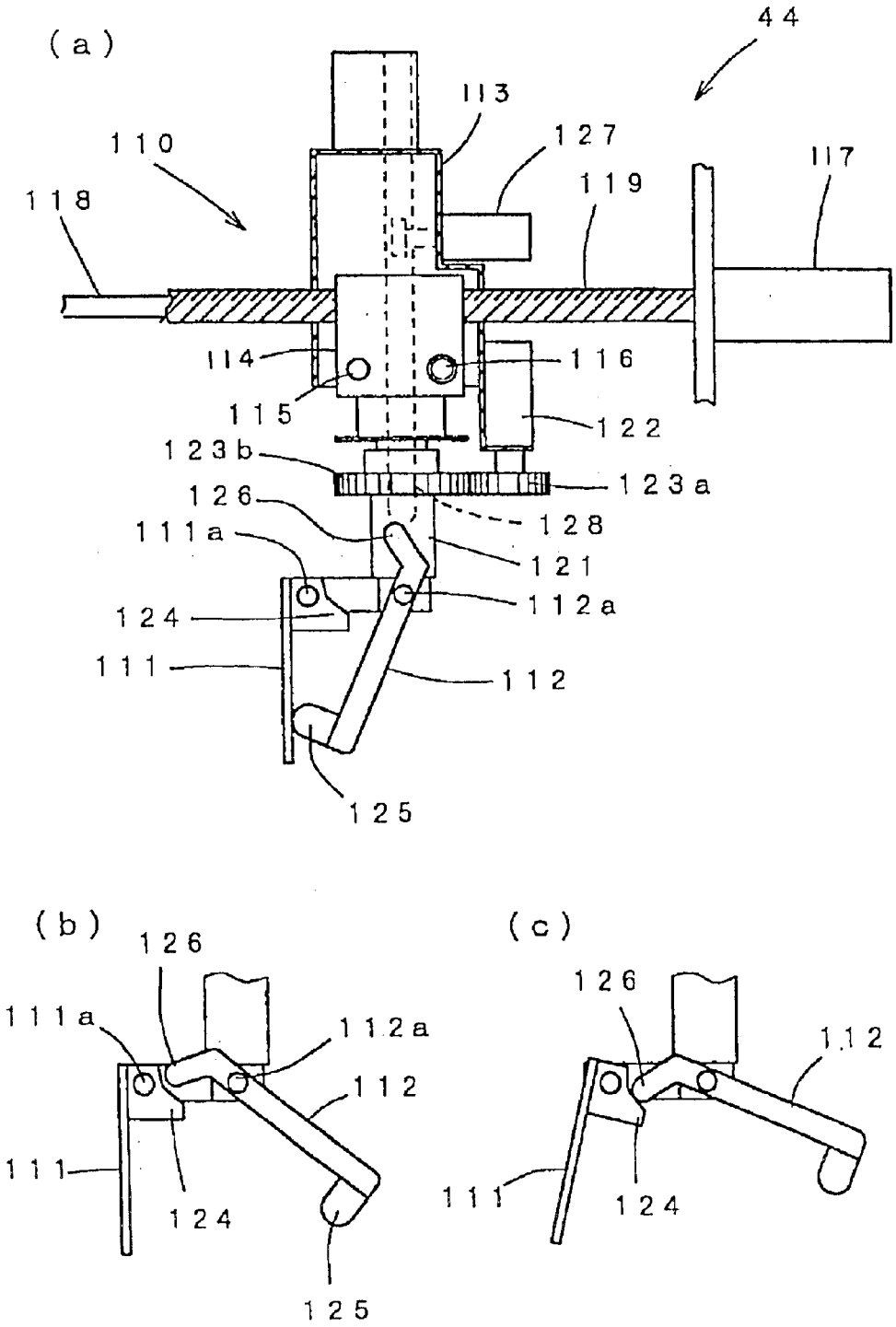
FIG. 9*a* is a front view showing a gripping member of FIG. 6.
FIG. 9*b* is a partial front view showing a first open condition.
FIG. 9*c* is a partial front view showing a second open condition.
Figure 10:
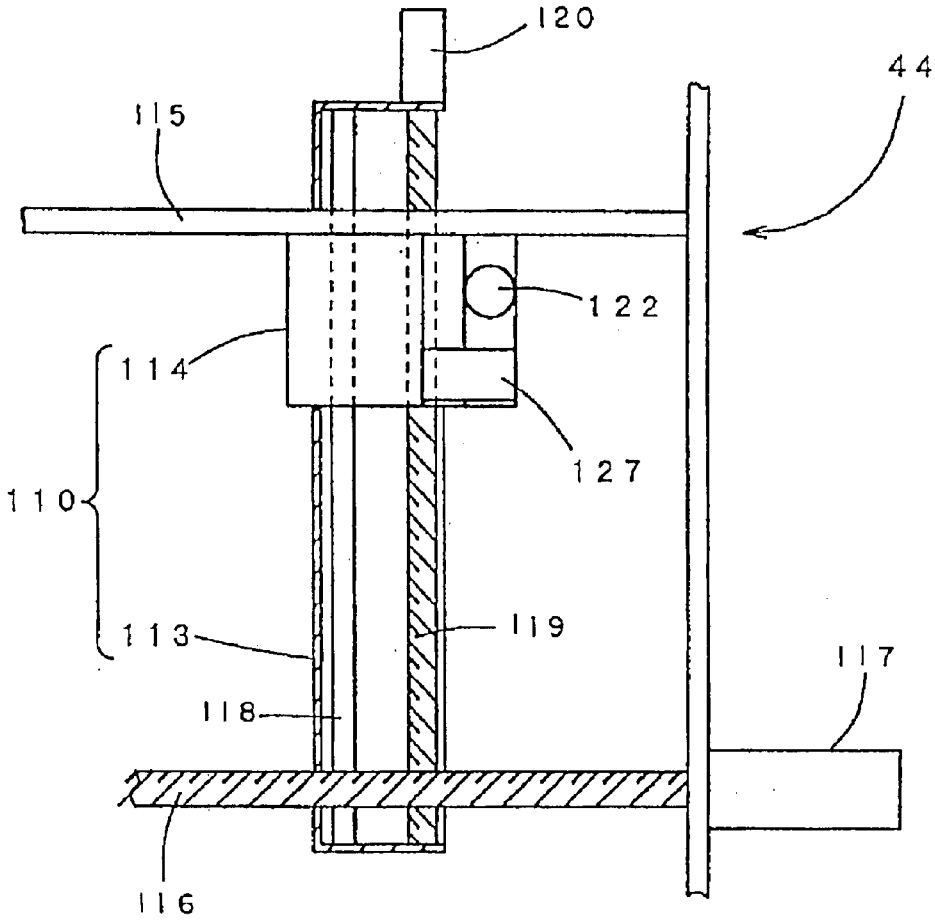
FIG. 10 is a plan view of FIG. 9*a;*

The gripping member 44, as shown in FIG. 9, is provided with a moving block 110, a first arm 111 and a second arm 112.

The moving block 110 comprises a first moving block 113 fabricated by bending a flat plate and a second moving block 114. The first moving block 113 is supported on a guide shaft 115 and a screw shaft 116 that are juxtaposed. When a motor 117 is driven to rotate the screw shaft 116, the first moving block 113 moves back and forth parallel to the inclined plate 41. In the same manner, the second moving block 114 is supported on a guide shaft 118 and a screw shaft 119 that are juxtaposed on the first moving block 113. When a motor 120 is driven to rotate the screw shaft 119, the second moving block 114 moves back and forth parallel to the inclined plate 41 in a direction perpendicular to the moving direction of the first moving block 113. Thus, both arms 111, 112 are movable to a guide position by the guide piece 47, a reel position by the reel member 43 and a binding position by the binding member 45.

Both arms 111, 112 are pivotably mounted on one end of a rotation shaft 121, which is provided on the second moving block 114, around support shafts 111*a*, 112*a* respectively. Driving a motor 122 causes the arms 111, 112 to turn via gears 123*a*, 123*b*. The first arm 111 has a plate-like shape and has a press-receiving portion 124 adjacent to the support shaft 111*a*. The second arm 112 has a resilient projection 125 on a distal end thereof and a press portion 126 on a proximal end thereof. When a motor 127 is driven to extend a rod 128, the end of the rod 128 presses the side edge of the press portion 126 to pivot the second arm 112.

The arms 111, 112 are urged by an unshown spring so that the ends thereof move toward each other to grip the medicine package belt between the resilient projection 125 and the first arm 111. When the motor 127 is driven to cause the rod 128 to extend and then press the press portion 126 of the second arm 112, the arms 111 , 112 pivot to a first open condition (refer to FIG. 9(*b*)) and a second open condition (refer to FIG. 9(*c*)). In the first open condition, only the second arm 112 pivots to separate from the first arm 111. In the second open condition, the second arm 112 further pivots to cause the first arm 111 to pivot and make the open angle larger.

Figure 7:
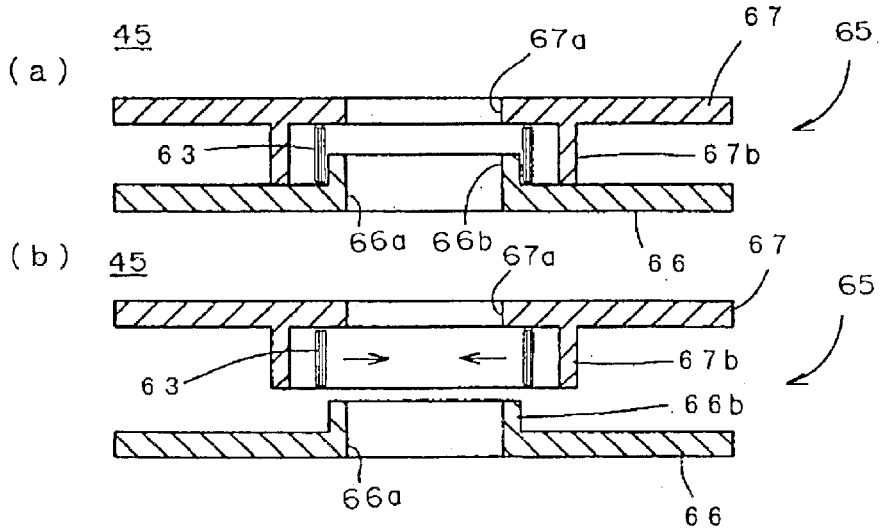
FIG. 7 is a sectional view showing a binding member of FIG. 1.

The binding member 45, as shown in FIGS. 1 and 7, is provided with a tape feed portion 64 for feeding a binding tape 63 and a guide member 65 for guiding the binding tape 63 fed from the tape feed portion 64 to make it circle. The guide member 65 comprises a first guide member 66 and a second guide member 67 which can approach and separate from each other in a direction of thickness. In the centers of the guide members 66, 67 are formed rectangular apertures 66*a*, 67*a* into which the medicine package belt gripped by the gripping member 44 is inserted. On the periphery of the rectangular aperture 66*a* of the first guide member 66 is formed an annular projection 66*b* projecting toward the second guide member 67, while around the rectangular aperture 67*a* of the second guide member 67 is formed an annular projection 67*b* projecting toward the first guide member 66. The annular projection 66*b* of the first guide member 66 is positioned inside the annular projection 67*b* of the second guide member 67. The projection dimension of the annular projection 66*b* of the first guide member 66 is half of that of the annular projection 67*b* of the second guide member 67. The space between the annular projection 66*b* and the annular projection 67*b* defines a guide passage for guiding the biding tape 63. The guide member 65 is provided with a heat-seal portion 68 for heat-sealing the binding tape 63 fed from the tape feed portion 64.

Next, operation of the aforementioned medicine packing apparatus will be explained.

In accordance with the prescription data from the host computer unshown, the medicine feed section 1 feeds the corresponding medicine. If the medicine can be automatically fed, such medicine is discharged from the tablet feeder 8 of the medicine automatic feed portion 5, while if the medicine should be manually fed, such medicine is discharged from the medicine manual feed portion 6. The pyrazolone medicine is directly fed to the medicine packing section through the one passage of the common hopper 38 from the first hopper 25. The nonpyrazolone medicine is once fed to the medicine delivery device 30 through the second hopper 26. In the medicine delivery device 30, the delivery motor 37 is driven to move the delivery vessel 32 in the direction of arrow Y', whereby the medicine contained in the delivery vessel 35 is fed to the medicine packing section through the other passage of the common hopper 38. Thus, the passages are completely separated, eliminating the remaining powder or so of the pyrazolone medicine from adhering to the nonpyrazolone medicine. In the case of using the hoppers without partition as the hopper 38, the hoppers are replaced with each other in both the case of supplying the nonpyrazolone medicine and the case of supplying the pyrazolone medicine.

The medicine packing section 2 packs the medicines fed from the medicine feed section 1 by one dose. Namely, as the elongated packing sheet 39 is unwound and folded into two, the packing sheet 39 is sealed by the cross heating heat roller 100 at positions spaced in the longitudinal direction. When the medicine is received in the opening of the packing sheet 39 through the common hopper 38, the opening is sealed with the longitudinal heating heat roller 101. The medicine package belt containing the medicine is cut with a cutter (unshown). In the case of an outpatient, the medicine package belt is cut by a unit of one-week dosages (21 packages) to obtain long medicine package belts. In the case of an inpatient, the medicine package belt is cut by an unit of one-day dosages (3 or 4 packages) to obtain short medicine package belts.

In the medicine package binding section 3, the medicine package belts are distributed by the distributing member 42 in accordance with the configurations thereof The configuration of the medicine package belt is automatically determined by the control section (i.e., discriminating mechanism) 4 based on the prescription data. For example, since the long medicine package belts are produced in the case of an outpatient and short medicine package belts are produced in the case of an inpatient, the distribution direction of the distributing member 42 may be decided based on whether the medicine package belt is for an outpatient or an inpatient.

Figure 11:
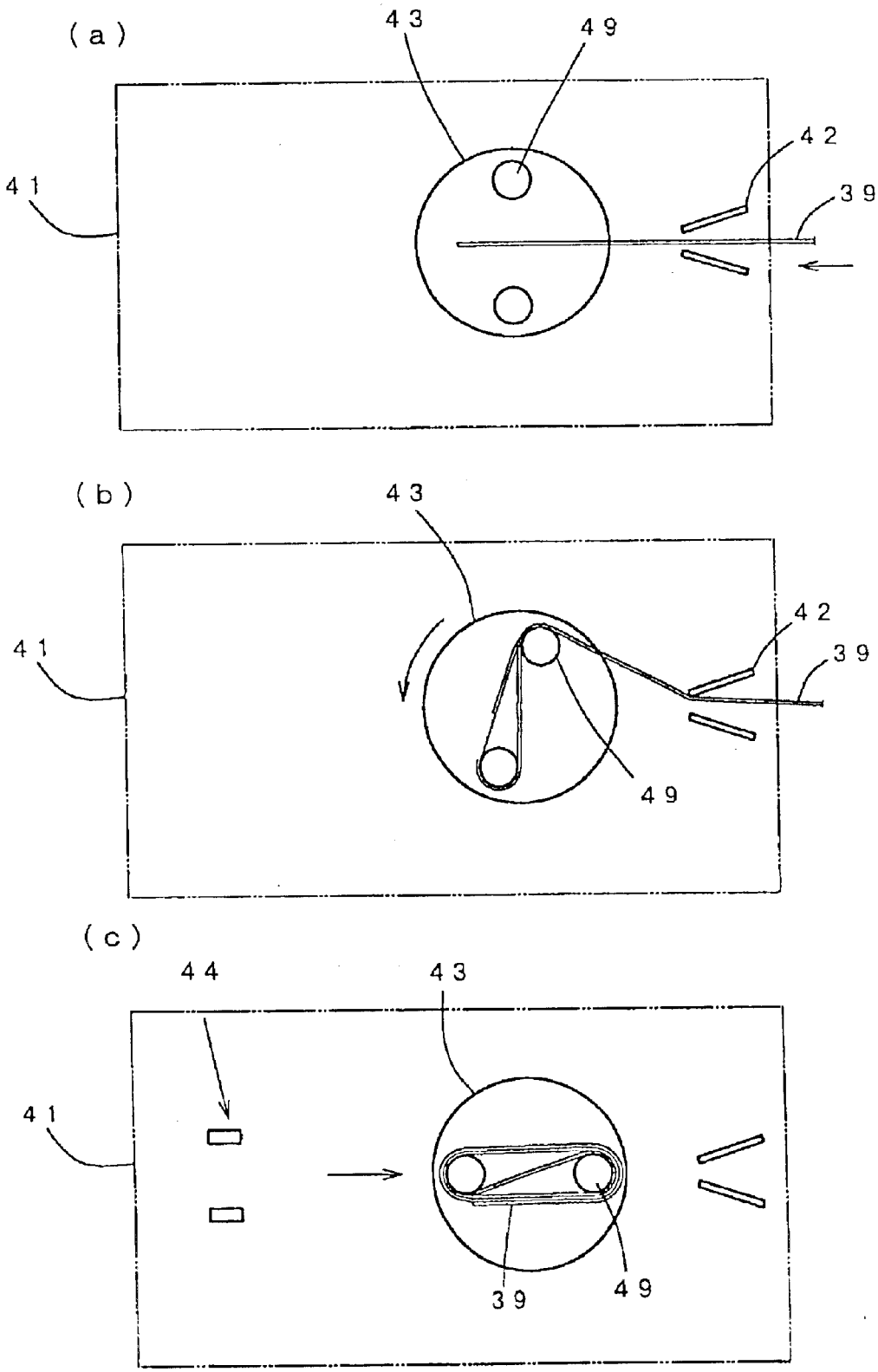
FIG. 11 is a schematic view showing a binding process of a long medicine package belt.

In the case of the long medicine package belts, as shown in FIG. 11(*a*), the distributing member 42 is positioned in a middle position so that the medicine package belt is straightly moved along an inclination direction of the inclined plate 41. Then, as shown in FIG. 11(*b*), the reel member 43 is driven to reel the medicine package belt around both guide shafts 49. The reel member 43 is stopped when the guide shafts 49 are directed to the inclination direction of the inclined plate 41 and the terminal end of the medicine package belt is positioned at the downstream side of the reel direction with respect to the lower side guide shaft 49 as shown in FIG. 11(*c*). Thus, the terminal end of the medicine package belt rewound on the reel member 43 is directed obliquely downwardly, making the medicine package belt difficult to be unwound.

Figure 12:
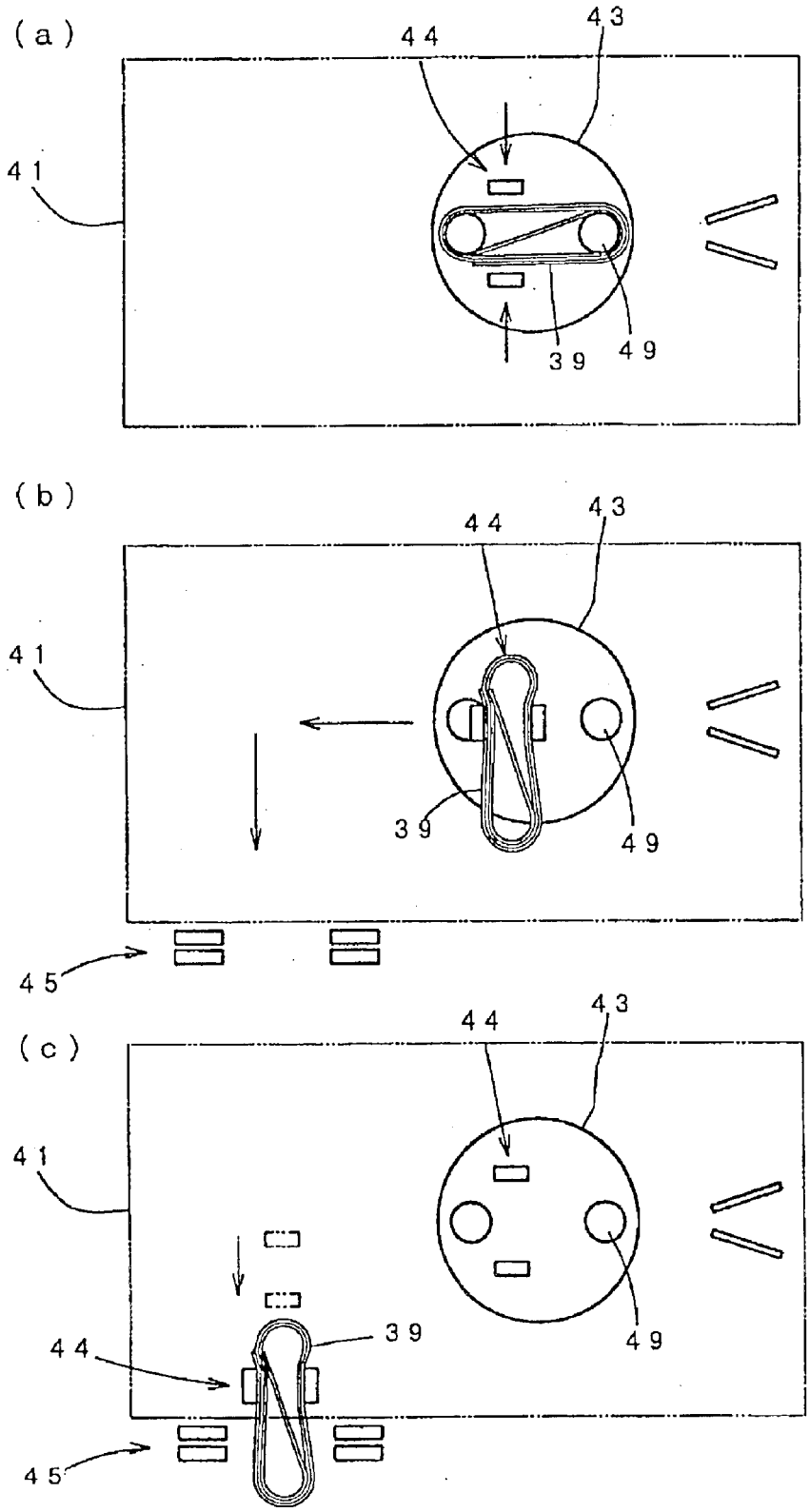
FIG. 12 is a schematic view showing a binding process of a long medicine package belt.

The gripping member 44 is positioned at an obliquely downward position with respect to the distributing member 42 and opened in the second open condition in advance. When finishing the reel of the medicine package belt, the gripping member 44 is moved upwardly along the inclined plate 41 as shown in FIG. 12(*a*). When the arms 111, 112 pass by the lower-side guide shaft 49 and are positioned on both sides of the reeled medicine package belt, the arms 111, 112 are operated to grip the medicine package belt. Then, as shown in FIG. 12(*b*), the reel member 43 descends and then the gripping member 44 is pivoted and moved toward the binding member 45.

Consequently, as shown in FIG. 12(*c*), the center portion of the medicine package belt gripped by the gripping member 44 is positioned in the rectangular apertures 66*a*, 67*a* of the guide member 65 of the binding member 45. In detail, the medicine package belt is positioned so as to come into contact with the obliquely downwardly situated side edges of the rectangular apertures 66*a*, 67*a*. Then, the binding tape 63 is fed to the guide member 65 from the tape feed portion 64. The binding tape 63 goes around the guide passage of the guide member 65. At this time, the first guide member 66 is disengaged from the second guide member 67, and then the binding tape 63 is rewound to bind the medicine package belt. Then, the overlapped portion of the binding tape 63 is heat-sealed by the heat-seal portion 68.

After that, the second arm 112 of the gripping member 44 is pivoted to the first open condition and the gripping member 44 is moved in the direction apart from the binding member 45. Then, as shown by the two-dots chain line in FIG. 12(*c*), the gripping member 44 is pivoted and moved so that the flat portion of the first arm 111 pushes the medicine package belt to discharge it through an unshown takeout port.

Figure 13:
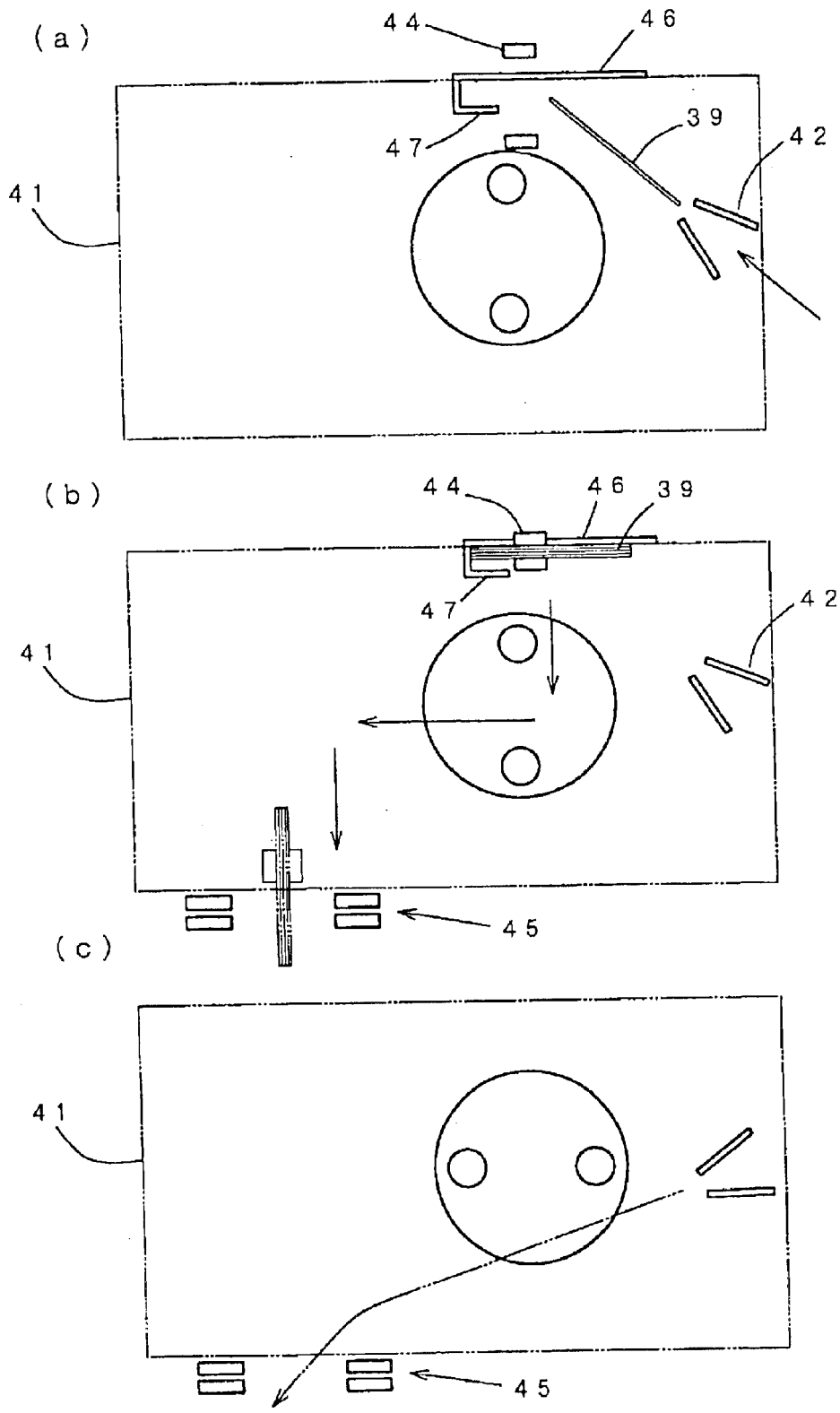
FIGS. 13*a* and 13*b* are schematic views showing a binding process of short medicine package belts.
FIG. 13*c* is a schematic view showing a discharging condition of blank package belts.

In the case of the short medicine package belts, as shown in FIG. 13(*a*), the distributing member 42 is pivoted to the guide wall 45 side. The guide piece 47 is moved in accordance with a cut length of the short medicine package belt. The gripping member 44 with the arms 111, 112 opened in the first open condition is moved in the vicinity of the guide piece 47. Every time that the short medicine package belts are fed, the second arm 112 is pivoted to assemble the short medicine package belts along the guide wall 46. Thus, the short medicine package belts can be smoothly supplied. When the supply of the short medicine package belts is completed, as shown in FIG. 13(*b*), the short medicine package belts are gripped by the gripping member 44 and conveyed to the binding member 45 to bind the center portion of the short medicine package belts in the same manner as described above. After that, the bound short medicine package belts are discharged.

In the case of the blank package belts, as shown in FIG. 13(*c*), the distributing member 42 is pivoted to the binding member 45 side. The blank package belts are formed if continuous packaging is not preferred, such as for different patients and so on. For example, if the prescription data is different, it is determined that the blank package belts are to be formed, whereby the distributing member 42 is pivoted to the binding member 45 side. In the passage to the rectangular aperture 66*a*, 67*a* of the binding member 45 from the distribution member 42, a guide passage may be preferably formed.

In the aforementioned embodiment, although two medicine feed passages are formed by the hoppers 25, 26, if three of more passages are necessary, hoppers with the number corresponding to that of the passages may be provided. In this case, as the medicine delivery device 30, for example, a belt conveyer or so is preferably used.

As is clear from the aforementioned explanation, according to the medicine packing apparatus of the present invention as a first means, because the type of medicine package belt can be automatically determined to distribute the medicine package belt, it is possible to easily supply the proper kind of medicine package belt in accordance with use thereof.

The length of the medicine package belt is determined, whereby the long medicine package belt is distributed toward the reel member and reeled, while the short medicine package belt is collected in the guide member. It is possible to properly recover the medicine package belts based on the length of the medicine package belts.

Particularly, the position of the guide member can be changed in accordance with the length of the short medicine package belt to be distributed, whereby more proper recovery of the medicine package belt is possible.

In addition, the blank package belt can be determined to discharge it, whereby it is possible to further automatize the supply of the medicine package belts.

According to the medicine packing apparatus of the present invention as a second means, because the open angle of the arms constituting the gripping means can be changed in accordance with the supply configuration determined by the discriminating means, various configurations of the medicine package belts can be properly gripped. Operation of the moving means causes the medicine package belts to be easily conveyed to a desired position. Therefore, a conveyance mechanism of the medicine package belts can be simplified.

In particular, in the case that the a plurality of the short medicine package belts are supplied one after another, opening and closing the arms causes the short medicine package belts to be collected, whereby the medicine package belts which are intermittently supplied can be surely gripped at a predetermined position.

In addition, one of the arms of the gripping means is formed with the press surface and the gripping means can be turned by the moving means, whereby the bound medicine package belts can be properly discharged by the press portion without needing new a mechanism.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A medicine packing apparatus comprising:

a discriminating mechanism for determining a configuration of a medicine package belt, the medicine package belt containing medicine in accordance with prescription data;

a distributing member for distributing the medicine package belt based on the configuration determined by said discriminating mechanism;

a reel member for winding a long medicine package belt distributed by said distributing member; and a guide member for guiding and collecting a short medicine package belt distributed by said distributing member;

wherein said distributing member is operable to distribute the long medicine package belt toward said reel member when said discriminating mechanism determines the configuration of the medicine package belt to be the long medicine package belt, and said distributing member is further operable to distribute the short medicine package belt toward said guide member when said discriminating mechanism determines the configuration of the medicine package belt to be the short medicine package belt.

2. The medicine packing apparatus of claim 1, wherein said guide member is movable so that a guide position of said guide member is adjustable based on a length of the short medicine package belt to be distributed by said distributing member.

3. The medicine packing apparatus of claim 2, wherein said distributing member is further operable to distribute a blank medicine package belt toward a discharge position when said discriminating mechanism determines the configuration of the medicine package belt to be the blank medicine package belt.

4. The medicine packing apparatus of claim 1, wherein said distributing member is further operable to distribute a blank medicine package belt toward a discharge position when said discriminating mechanism determines the configuration of the medicine package belt to be the blank medicine package belt.

5. The medicine packing apparatus of claim 4, further comprising a binding member for binding the medicine package belt with binding tape after the medicine package belt is distributed to one of said reel member, said guide member, and said discharge position by said distributing member.

6. The medicine packing apparatus of claim 5, further comprising a gripping member for holding the medicine package belt during a transfer of the medicine package belt from said one of said reel member, said guide member, and said discharge position to said binding member.

7. The medicine packing apparatus of claim 1, further comprising a binding member for binding the medicine package bell with binding tape after the medicine package belt is distributed to one of said reel member and said guide member by said distributing member.

8. The medicine packing apparatus of claim 7, further comprising a gripping member for holding the medicine package belt during a transfer of the medicine package belt from said one of said reel member and said guide member to said binding member.

9. A medicine packing apparatus comprising:

a discriminating mechanism for determining a configuration of a medicine package belt, the medicine package belt containing medicine in accordance with prescription data;

a gripping member having a first arm and a second arm operable to move with respect to each other so as to change an angle between said first arm and said second arm based on the configuration of the medicine package belt determined by said discriminating mechanism, said gripping member being operable to grip the medicine package belt; and a moving member for moving the medicine package belt gripped by said gripping member to a binding position;

wherein said gripping member is operable to change an open angle between said first arm and said second arm to a maximum angle and said moving member is operable to move said gripping member toward a reeled-condition long medicine package belt so as to grip the long medicine package belt when said discriminating mechanism determines the configuration of the medicine package belt to be the long medicine package belt, and said gripping member is operable to change an open angle between said first arm and said second arm to a less-than-maximum angle so as to grip a collected-condition short medicine package belt when said discriminating mechanism determines the configuration of the medicine package belt to be the short medicine package belt.

10. The medicine packing apparatus of claim 9, wherein one of said first arm and said second arm of said gripping member has a press portion, said moving member being operable to turn said gripping member so that said press portion presses the medicine package belt gripped by said gripping member at a binding position to discharge the medicine package belt.

11. The medicine packing apparatus of claim 9, further comprising:

a distributing member for distributing the medicine package belt based on the configuration determined by said discriminating mechanism;

a reel member for winding a long medicine package belt distributed by said distributing member; and a guide member for guiding and collecting a short medicine package belt distributed by said distributing member.

12. The medicine packing apparatus of claim 11, wherein said guide member is movable so that a guide position of said guide member is adjustable based on a length of the short medicine package belt to be distributed by said distributing member.

13. The medicine packing apparatus of claim 12, wherein said distributing member is further operable to distribute a blank medicine package belt toward a discharge position when said discriminating mechanism determines the configuration of the medicine package belt to be the blank medicine package belt.

14. The medicine packing apparatus of claim 11, wherein said distributing member is further operable to distribute a blank medicine package belt toward a discharge position when said discriminating mechanism determines the configuration of the medicine package belt to be the blank medicine package belt.

15. The medicine packing apparatus of claim 14, further comprising a binding member for binding the medicine package belt with binding tape after the medicine package belt is distributed to one of said reel member, said guide member, and said discharge position by said distributing member.

16. The medicine packing apparatus of claim 11, further comprising a binding member for binding the medicine package belt with binding tape after the medicine package belt is distributed to one of said reel member and said guide member by said distributing member.

17. The medicine packing apparatus of claim 9, further comprising a binding member at the binding position for binding the medicine package belt with binding tape after the medicine package belt is moved by said moving member.

* * * * *